US006257373B1

(12) United States Patent
Hikita et al.

(10) Patent No.: US 6,257,373 B1
(45) **Date of Patent: *Jul. 10, 2001**

(54) APPARATUS FOR CONTROLLING ALLOCATION OF ELEVATORS BASED ON LEARNED TRAVEL DIRECTION AND TRAFFIC

(75) Inventors: Shiro Hikita; Kenichi Uetani, both of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,536

(22) Filed: Mar. 22, 1999

(51) Int. Cl.[7] ..... B66B 3/00
(52) U.S. Cl. ..... 187/392; 187/392; 187/387
(58) Field of Search ..... 187/380, 381, 187/382, 385, 386, 391, 392, 387

(56) References Cited

U.S. PATENT DOCUMENTS 3,967,702 * 7/1976 Iwaska et al. ..... 187/29 R
4,536,842 * 8/1985 Yoneda et al. ..... 364/424
4,672,531 * 6/1987 Uetani ..... 364/138
5,272,288 * 12/1993 Kameli ..... 187/127
5,276,295 * 1/1994 Kameli ..... 187/132
5,329,076 * 7/1994 Kameli ..... 187/127

FOREIGN PATENT DOCUMENTS 55-46480 3/1980 (JP) .
62-31679 2/1987 (JP) .
1230185 8/1989 (JP) .
4106081 4/1992 (JP) .
4266373 9/1992 (JP) .
4358677 12/1992 (JP) .
5262482 10/1993 (JP) .
687579 3/1994 (JP) .
8161292 6/1996 (JP) .

* cited by examiner

*Primary Examiner*—Jonathan Salata
(74) *Attorney, Agent, or Firm*—Leydig, Voit & Mayer, Ltd.

(57) ABSTRACT

An administrative controlling apparatus for elevators, for calling an elevator before a passenger's operation of a hall call button when a passenger who has come to an elevator hall is detected by passenger detection devices. The direction in which the passenger would like to go is predicted based upon the hall call and past passengers. Accordingly, the past usage is regarded as a basis for a statistical learning process. On this basis, the selection of a stand-by elevator or the selection of a tentative allocation elevator is effected. Also, a call is interrupted in accordance with the absence or presence of an elevator call.

14 Claims, 10 Drawing Sheets

APPARATUS FOR CONTROLLING ALLOCATION OF ELEVATORS BASED ON LEARNED TRAVEL DIRECTION AND TRAFFIC

TECHNICAL FIELD

The present invention relates to an administrative controlling apparatus for elevators, and to a controlling apparatus for effectively operating an elevator by calling an elevator cage before passengers manipulate calling buttons.

BACKGROUND ART

Conventionally, in the case where a plurality of elevators are concentratedly disposed as one group, a group administrative controlling apparatus is used in which passengers who come to an elevator hall manipulate hall call buttons provided commonly for the group of elevators so that the call is registered, and a cage to respond to the call is selected and allocated.

Recently, it is proposed in Japanese Utility Model Application Laid-Open (Jikkai-Sho No. 55-46480) that, in order to enhance convenience for the passengers, the passenger who comes to the elevator hall is detected without the passenger's manipulation of the hall call button and a hall call in a predetermined direction is registered. Also, a group administrative controlling apparatus is proposed in Japanese Patent Application Laid-Open (Tokkai-Hei No. 1-203185), which is characterized in that, when the passenger who comes to the elevator hall is detected, a predetermined call is tentatively registered, the cage to respond to the call is selected and allocated, and doors are opened when the cage to respond thereto is stopped or as soon as the cage has been stopped, whereby the cage that will respond to the call is notice early by the passenger.

However, the passenger who comes to the elevator hall does not always register the call in the predetermined direction. There are cases where the predetermined direction is different from a direction in which the passenger would like to go. There is a fear that the passenger would get on a wrong cage when the doors are opened. Also, since the call for the direction in which the passenger would like to go is not registered even if the passenger waits for the cage for a very long time, there is a case where the cage could not be called. Furthermore, in such a case, there is a problem in which an unnecessary call is registered in allotting the cage by the group administrative controlling apparatus so that the service of the group of the elevators would be worse.

Also, all the people who come to the elevator hall are not the passengers for the elevators, and there is a case where some people leave the elevator hall without getting on the elevators. If the predetermined call is registered in such a case, the elevator is called in spite of the fact that no passenger uses the elevator. For a while, the elevator stops at that floor with the doors open. As a result, the operation efficiency of the elevators is deteriorated, and the waiting time for other passengers is elongated, resulting in deterioration of the service of the group of the elevators.

Accordingly, an object of the invention is to provide an administrative controlling apparatus for elevators, in which the directions which are registered by the passengers who come to the elevator hall are learned so that an optimum tentative registration is intended, and at the same time the tentative registration is corrected by the buttons manipulated by the passengers, if necessary, whereby the passengers' waiting time is shortened, and the operation efficiency of all the group of elevators is enhanced so that the service for all the users may be enhanced.

Also, another object of the invention is to provide an administrative controlling apparatus for elevators which may ensure the like effect even if the invention is applied not only to the group of elevators but also a single elevator.

DISCLOSURE OF THE INVENTION

According to the invention, since the hall button in a direction which would be designated at the time when the passenger comes to the elevator hall is predicted with high precision based on the past learned history before the passenger manipulates the hall button, and the tentative allocation is performed, it is possible to call the cage while having the cage have a direction in an early stage before the passenger makes a hall call. Accordingly, it is possible to shorten the passenger's waiting time at the elevator hall and at the same time the direction may be exhibited upon the arrival of the cage, whereby the next start may smoothly be effected.

Also, according to the invention, since the people who come to the elevator hall after the tentative allocation are not the passengers at all for the elevators, it is determined that they are not the passengers in the case where they do not manipulate the hall buttons, there is no arrival forecast or arrival alert in the elevator hall and also the doors are not to be opened, whereby the unnecessary operations are obviated, and any unusual feeling would not be given to the people who come to the elevator hall and are not the passengers.

Furthermore, according to the invention, the direction of hall call which has been forecasted and tentatively allocated is not always identical with the direction of hall call which has been manipulated by the passenger, and in such a case, the direction is corrected in accordance with the passenger's intention.

According to the invention, since the hall button in a direction in which the passenger would manipulate the button at the time the passenger comes to the elevator hall is predicted and tentatively allocated before the passenger manipulates the hall button on the basis of the past leaned history, it is possible to call the cage while having the cage have a direction in an early stage before the passenger makes the call. Accordingly, it is possible to shorten the passenger's waiting time at the elevator hall and at the same time the next start may smoothly be effected.

Also, according to the invention, the tentative allocation is effected on the basis of the past learned result. However, since all the people who come to the elevator hall are not always the passengers, it is determined that they are not the passengers in the case where they do not manipulate the hall buttons, there is no arrival forecast or arrival alert in the elevator hall and also the doors are not to be opened, whereby the unnecessary operations are obviated, and furthermore any unusual feeling would not be given to the people who come to the elevator hall and are not the passengers.

Furthermore, according to the invention, the direction of the hall call which has been forecasted and tentatively allocated on the basis of the past learned result is not always identical with that of hall call which has been manipulated by the passenger, and in such a case, the direction is corrected in accordance with the passenger's intention. The tentative allocation is canceled and a new optimum cage is selected and the call therefor is allocated.

Also, according to the invention, the tentative allocation is effected by the forecast on the basis of the past leaned result. It is possible to predict the optimum tentative allocation call in the same time slot on the floor in accordance with the simple accumulation of data in the past.

According to the invention, the passenger who approaches the elevator hall is detected to thereby perform the parking allocation to call the elevator, and when the passenger manipulates the hall call button, the elevator responds to the call to disable the parking allocation. Accordingly, since the parking allocation is performed at the time when the passenger comes into the elevator hall before the passenger manipulates the hall button, the cage may be called in an early stage before the passenger makes the call. Accordingly, it is possible to shorten the waiting time of the passengers at the elevator hall.

Also, according to the present invention, the parking allocation is performed at the time when the passenger approaches the elevator hall but in the case where the passenger has not manipulate the hall call button, the arrival forecast or arrival alert is not effected upon the arrival of the elevator. Accordingly, since all the people who come into the elevator hall are not always the passengers, it is judged that the people are not the passengers if they do not manipulate the hall button, the arrival forecast or arrival alert is not effected and the doors are not opened. Thus, the unnecessary operations are eliminated. Furthermore, it is possible to avoid the unusual feeling to the people who come to the elevator hall and are not the passengers.

Furthermore, according to the invention, if another call is made before the arrival at the floor in which the cage which is subjected to the parking allocation, is to stand-by, the parking allocation is disabled. The elevator service is effected for the call for which the hall button is actually manipulated on another floor with a priority to the parking allocation effected before the registration of the hall call on the subject floor. Thus, the intention of the passenger is clear and the priority is given to one which is earlier manipulated.

According to the invention, the passenger who approaches the elevator hall is detected so that the elevator which is subjected to the parking allocation is selected and called from the group of elevators. When the hall call button is manipulated by the passenger, the elevator responds to the hall call and the parking allocation is disabled. Accordingly, since the parking allocation is performed at the time the passenger comes into the elevator hall before the manipulation of the hall button by the passenger, it is possible to call the cage in the early stage before the passenger makes a call. Accordingly, it is possible to shorten the waiting time of the passengers at the elevator hall.

Also, according to the invention, the selection from the group of elevators is performed to thereby effect the parking allocation at the time the passenger approaches the elevator hall. However, in the case where the passenger has not manipulated the hall call button, the arrival forecast or arrival alert is not effected upon the arrival of the elevator. Accordingly, since all the people who come into the elevator hall are not always the passengers, it is judged that the people are not the passengers if they do not manipulate the hall button, the arrival forecast or arrival alert is not effected and the doors are not opened. Thus, the unnecessary operations are eliminated. Further, it is possible to avoid the unusual feeling to the people who come to the elevator hall and are not the passengers.

Furthermore, according to the invention, if another call is made before the arrival at the floor in which the cage which is subjected to the parking allocation among the group of elevators, is to stand-by, the parking allocation is disabled. The elevator service is effected for the call for which the hall button is actually manipulated on another floor with a priority to the parking allocation effected before the registration of the hall call on the subject floor. Thus, the intention of the passenger is clear and the priority is given to one which is earlier manipulated.

Also, according to the invention, a cage which waits for the call on the subject floor and which is not subjected to the hall call allocation among the group of elevators is included in the possible parking allocation group. It is therefore possible to respond thereto and it is possible to broaden the range of selection for the parking allocation.

According to the invention, it is possible to predict whether the tentative allocation or the parking allocation is effected in accordance with the simple accumulation of past data. Namely, when the direction in which the passenger goes (the hall button operational direction) is not clear in the UP/DOWN mode, at first, it is regarded as the parking allocation and the subject cage is called, whereas in the time slot during which the direction in which the passenger goes is clear from the past history, the direction is designated and the tentative allocation is performed.

Also, according to the invention, it is possible to predict the optimum allocation, i.e., whether the tentative allocation or the parking allocation is to be effected in the same time slot on the subject floor in accordance with the simple accumulation of past data. Namely, when the direction in which the passenger goes (the hall button operational direction) is not clear in the UP/DOWN mode, at first, it is regarded as the parking allocation and the subject cage is called, whereas in the same time slot during which the direction in which the passenger goes is clear from the past history, the direction is designated and the tentative allocation is performed.

BEST MODE FOR CARRYING OUT THE INVENTION

The present invention will now be described in detail with reference to the accompanying drawings.

Figure 1:
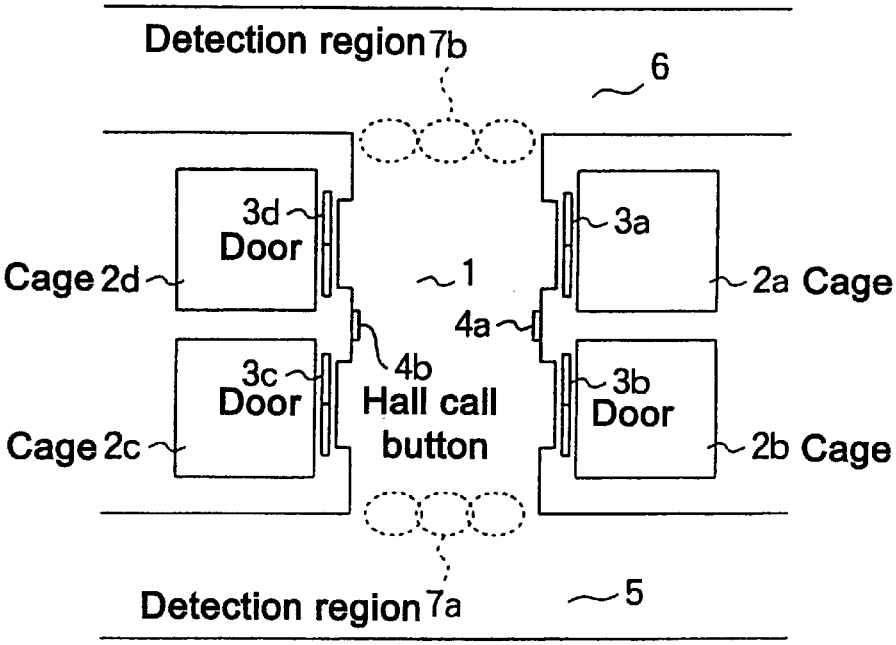
FIG. 1 is a view showing an elevator hall provided with a group administrative apparatus according to the invention.
Figure 2:
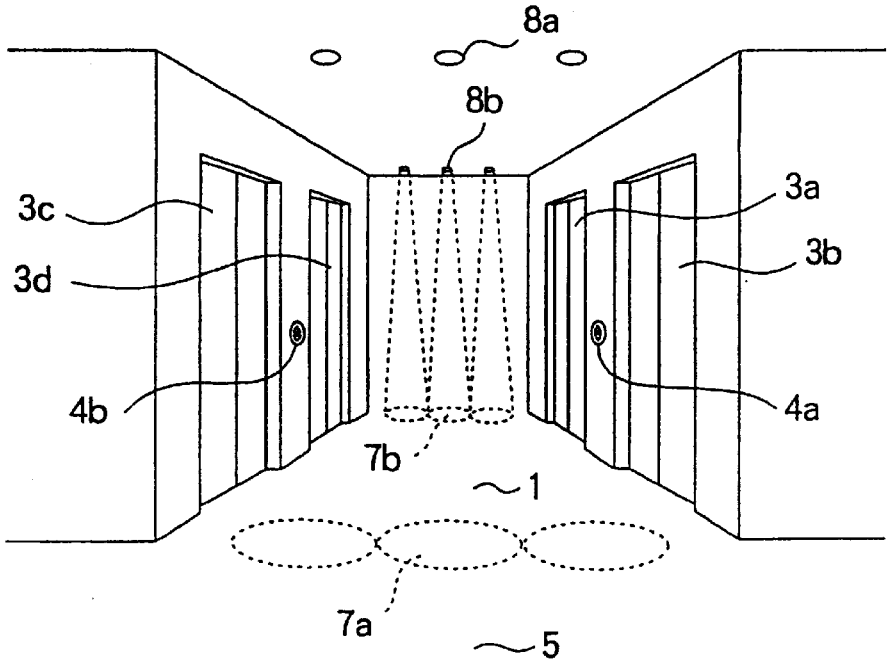
FIG. 2 is a perspective view of the elevator hall shown in FIG. 1.

FIG. 1 is a view showing an elevator hall of elevators provided with a group administrative apparatus according to the invention, and FIG. 2 is a perspective view of the elevator hall shown in FIG. 1, in which cages 2*a*, 2*b*, 2*c* and 2*d* to be administrated and controlled as a group in accordance with the group administrative controlling apparatus are provided to face the elevator hall 1 of the elevators. Passengers may get on or off through doors 3*a*, 3*b*, 3*c* and 3*d* which are to be opened or closed between the elevators and the elevator hall 1, respectively. Hall call buttons 4*a* and 4*b* for registering calls in a direction in which a passenger would like to go are provided in the elevator hall 1. The passenger enters the elevator hall 1 from passages 5 and 6 adjacent to the elevator hall 1. Detection regions 7*a* and 7*b* for detecting the passengers are provided on joint portions between the elevator hall 1 and the passages 5 and 6. Passenger detecting devices 8*a* and 8*b* for detecting the passengers who come to these regions are provided on a ceiling of the elevator hall 1. It is possible to apply as the passenger detecting devices 8 units composed of infrared ray sensors utilizing an infrared ray or any other various units such as a laser sensor, a floor mat sensor or a detector that may process images picked up by a camera, all of which are well known for those skilled in the art. Namely, when the passengers who enter the elevator hall 1 from the passages 5 and 6 pass through the detection regions 7*a* and 7*b*, they are detected by the passenger detecting devices 8. The information thereof is transmitted to a group administrative controlling apparatus to be described later.

Embodiment 1

Figure 3:
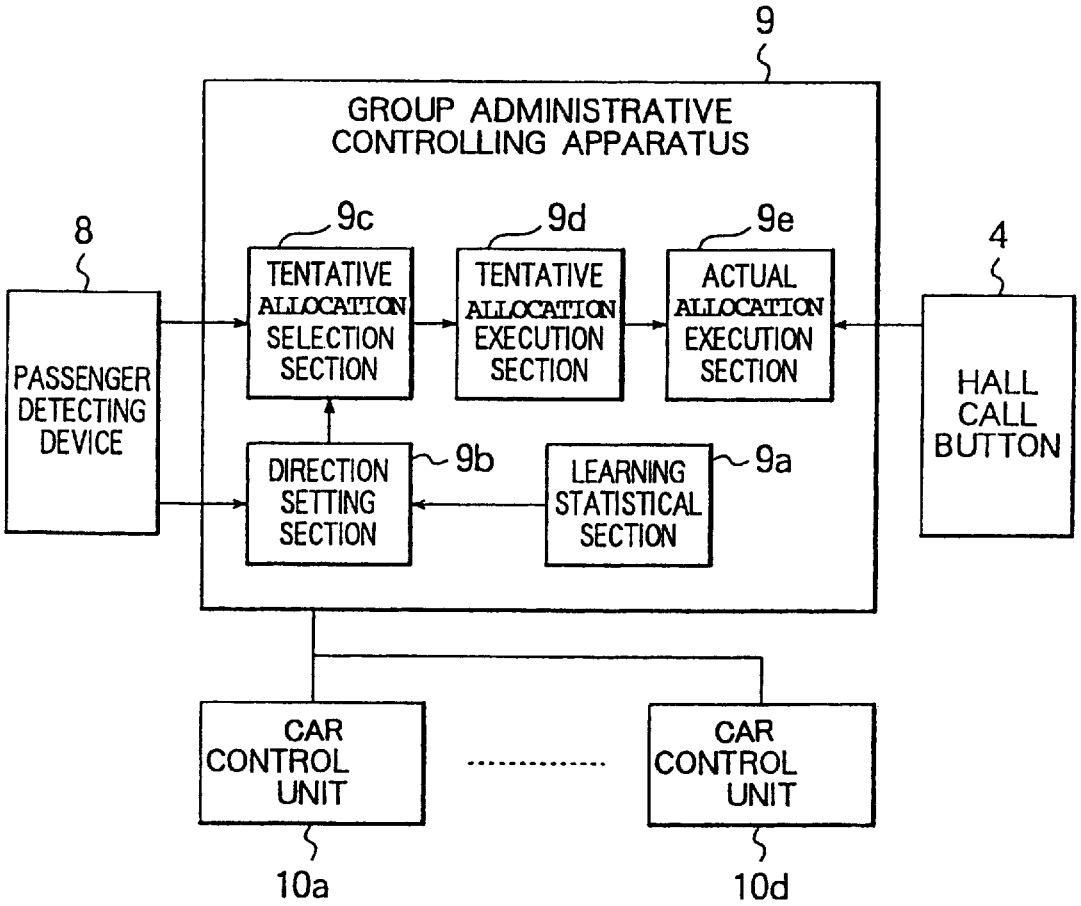
FIG. 3 is a block diagram showing a structure in accordance with embodiment 1 of the invention.
Figure 4:
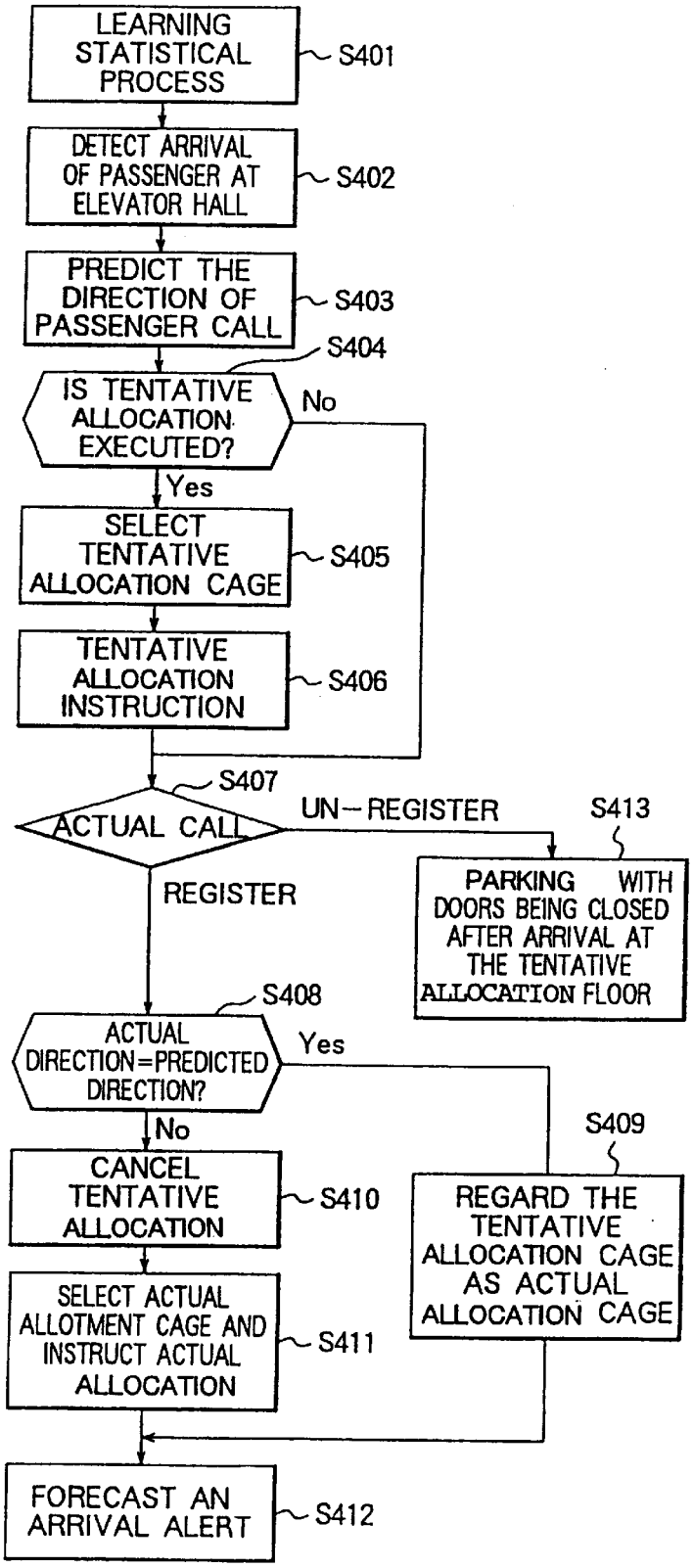
FIG. 4 is a flowchart illustrative of the operation of embodiment 1 of the invention.

FIG. 3 is a block diagram showing a structure in accordance with embodiment 1 of the invention, and FIG. 4 is a flowchart illustrative of the operation of embodiment 1 of the invention.

In FIG. 3, numeral 9 denotes a group administrative controlling apparatus for administrating and controlling the single group of elevators shown in FIG. 1, which is connected to car control unit 10*a*, 10*b*, 10*c* and 10*d* (some of which are not shown). Incidentally, the hall call buttons 4 and the passenger detecting devices 8 are the same as those described above. Also, the group administrative controlling apparatus 9 is composed of a learning statistical section 9*a* for learning for every predetermined time period an operational history of the elevators including the registered number of travels of the hall call buttons for every floors in different directions or the registered number of the passengers in different directions and for analyzing the features thereof, a direction setting section 9*b* for predicting, in response to the learned result of the above-described learning statistical section 9*a*, the directions (UP/DOWN) which are to be forecast to be registered and which are manipulated by the hall buttons on the subject floor when the passenger detecting devices 8 detect the people, a tentative allocation selection section 9*c* for selecting the cage to respond to the hall call in the predicted direction, a tentative allocation execution section 9*d* for tentatively allotting the call to the selected cage, and an actual allocation execution section 9*e* for selecting the case to respond to the call in accordance with the hall call button 4 actually operated by the passenger. Incidentally, the actual allocation execution section 9*e* may alert the selected cage to the passenger as a forecast.

Here, the allocation is continued by the actual allocation execution section 9*e* in the case where the passenger on the subject floor operates the hall call button 4, and the tentatively allocated direction is identified with the direction which is designated by the hall call button 4 after the tentative allocation has been effected. The tentative allocation is canceled thereby in the case where the tentatively allocated direction is not identified with the direction which is designated by the hall call button 4. The elevator which is to respond thereto is selected in accordance with the direction of the elevator call button 4 that has been newly operated so that the subject hall call allocation is newly allocated to its cage.

Also, by the actual allocation execution section 9*e*, in the case where the passenger on the subject floor has not manipulated the hall call button 4 from the tentative allocation by the arrival at the tentatively allocated floor, or in the case where another call is not allocated to the subject cage, the arrival forecast or arrival alert is not effected but the cage is caused to stand by on the allocated floor with its doors being closed after the arrival.

Furthermore, the direction setting section 9*b* is constructed so as to determine the direction of the call upon the tentative allocation on the basis of the number of travels in different directions of the ascending direction and descending direction registered by the hall call button in the same previous time interval on the subject floor and/or the number of the passengers.

The operation of the group administrative controlling apparatus of the elevators in accordance with embodiment 1 described above will now be described with reference to the flowchart shown in FIG. 4.

First of all, in step S401, the usage of the passengers for every day is statistically processed by the learning statistical section 9*a* and a learning statistical process is executed for forecasting the number of the passengers in different directions on respective floors for every predetermined time interval. Since this process takes a relatively long time, there are many cases where a so-called background process is effected. Here, the forecast number of the passengers in different directions on each floor is represented by {Pup(f1), Pdn(f1)}. Namely, Pup(f1): the number of the passengers in the UP directions for every unit hour on the floor f1

Pdn(f1): the number of the passengers in the DOWN directions for every unit hour on the floor f1 equation <1>

In step S402, if the passenger's arrival at the elevator hall 1 is detected by the passenger detecting devices 8, then the forecast calling direction which is forecast to be operated by the passenger, is predicted by using the direction setting section 9*b* by using data of the learning statically section 9*a*. Namely, a method using the data of the above-described equation <1> will be described as an predicted example in this direction.

In this example, the ratio of the people in different directions is important. Namely, it is forecast and set that it is the UP direction when Pup(f1)>Pdn(f1) and it is the DOWN direction when Pup(f1)<Pdn(f1).

Also, the ratio {Ratio} in accordance with the following equation <2> is calculated, and is transmitted to the tentative allocation selection section 9*c* together with the forecast direction. Incidentally, when Pup(f1)=Pdn(f1), there are various thoughts. For example, it would be sufficient that, in a so-called basic floor or a threshold floor, the direction in which the number of remaining floors is large, is generally set to the UP direction, whereas in other floors, the direction is determined to be a direction toward the standard floor or threshold floor, in advance.

Ratio=$Pup(f1)/Pdn(f1)$: the case where the forecast is in the UP direction

Ratio=$Pdn(f1)/Pdn(f1)$: the case where the forecast is in the DOWN direction equation <2>.

In step S404, the judgement whether or not the tentative allocation is to be executed in the tentative allocation selection section 9*c* is made. For instance, as one means for this judgement, there is a method using a rule defined by the following equation <3>. Here, Th is the threshold value. Namely, thereby, it is meant that the tentative allocation is not effected when the difference in direction of the forecast number of the people is small.

IF (Ratio>Th)

THEN Execute tentative allocation

ELSE Do not tentative allocation equation <3>

In step S404, if it is judged that the tentative allocation is not performed, and the allocation is held until the passenger actually operates the call, the process is advanced to step S407. Also, if it is judged that the tentative allocation is to be performed, the process is advanced to step S405 and the following steps are executed.

Incidentally, in the above-described steps S403 and S404, according to the learning statistical result, it is meant that if the numbers of persons in the UP direction and in the DOWN direction are different from each other to some extent, the tentative allocation is performed based on the difference in the direction in which the number of the persons is greater, and if the difference is small, the tentative allocation is not performed. It is set, by using the threshold value Th as described above, at what difference the tentative allocation should be performed. There are various methods for finding a suitable value for the value Th. It is preferable to set the proposed value by confirming the effect by simulation or the like.

Subsequently, in step S405, the cage which is to be subjected to the tentative allocation is selected by the tentative allocation selection section 9*c* by using the predicted calling direction that would be operated by the passenger in step S403. In step S406, the tentative allocation instructions representative of the execution of the tentative allocation are fed to the respective controlling units 10 for the cages selected for the above-described tentative allocation in the tentative allocation execution section 9*d*. The cage that is subjected to the tentative allocation instruction recognizes that the subject allocated floor is the floor on which the cage is to be stopped. The cage travels in predetermined steps (not shown). For the selection of the tentatively allocated cage in this step S405, it is preferable to perform the selection of the tentative allocation cage totally in consideration of forecast waiting time for the passenger, the probability of full occupation, the probability of failure of the forecast or the like (not shown) in the same manner as in the allocation to the called cage in the conventional group administrative controlling apparatus.

In step S407, if the actual call is registered by the operation of the hall call button 4 by the passenger who has come to the elevator hall, then it is judged in step S408 whether the registered actual call is identified in direction with the call predicted in the above-described step S403. Incidentally, in the case where it is judged that the tentative allocation is not to be performed in the above-described step S404, it is deemed that the directions are not identified with each other.

If the judgement in this step S408 is made as an identification, the process moves to step S409. The cage which receives the tentative allocation instruction in the above-described step S406 is allocated as the actual allocation cage for the call registered instep S407 without any modification. The process moves to step S412. The forecast of the arrival cage or the alert of the arrival is performed for the passengers at the elevator hall.

Also, if the judgement in this step S408 is made as no identification, and if the cage is subjected to the tentative allocation instruction in the above-described step S406, its allocation is canceled in the subsequent step S410. Accordingly, the subject cage responds to another call that is allocated to the cage. Namely, if there is another call in the travel direction, the subject cage travels continuously and responds to the call, and if there is no allocated call, the cage is stopped at the closest floor.

Subsequently, in step S411, the cage to be allocated for the actual call registered in step S407 is selected as the actual allocation cage, and the actual allocation instruction representative of the actual allocation is fed to car control unit 10 corresponding to this cage. Then, in step S412, the forecast of the arrival cage or the alert of the arrival is performed for the passengers at the elevator hall. The selection of the actual allocation cage in this step S411 is performed by totally evaluating the forecast waiting time for the passengers, the probability of the full occupation, the probability of failure of the forecast or the like in the same manner as in the above-described step S405.

Also, in the case where the actual call is not registered in step S407, that is, the passenger at the subject floor has not manipulated the hall call button, from the tentative allocation the cage at the tentatively allocated floor, also in the case where another call is not allocated to the cage arrives, the arrival forecast or arrival alert is not performed in step S413, and the cage is put on stand-by with the doors being closed on the allocated floor after the arrival of the cage to wait for the actual call registration. Incidentally, the operations from the above-described step S407 to step S412 and step S413 are executed in the actual allocation execution section 9*e*.

As described for embodiment 1, in the group administrative controlling apparatus of the elevators according to the invention, when the arrival of the passenger at the elevator hall is detected, it is possible to more quickly call the cage through the tentative allocation before the manipulation of the hall call button. Accordingly, it is possible to provide an elevator earlier for the passenger who has come to the elevator hall.

Also, in embodiment 1, a single group of a plurality of elevators is controlled has been described, but the number of the elevators to be controlled may be one and the invention may be applied to the case of at least one elevator.

Embodiment 2

Embodiment 2 for embodying the invention will now be described.

Figure 5:
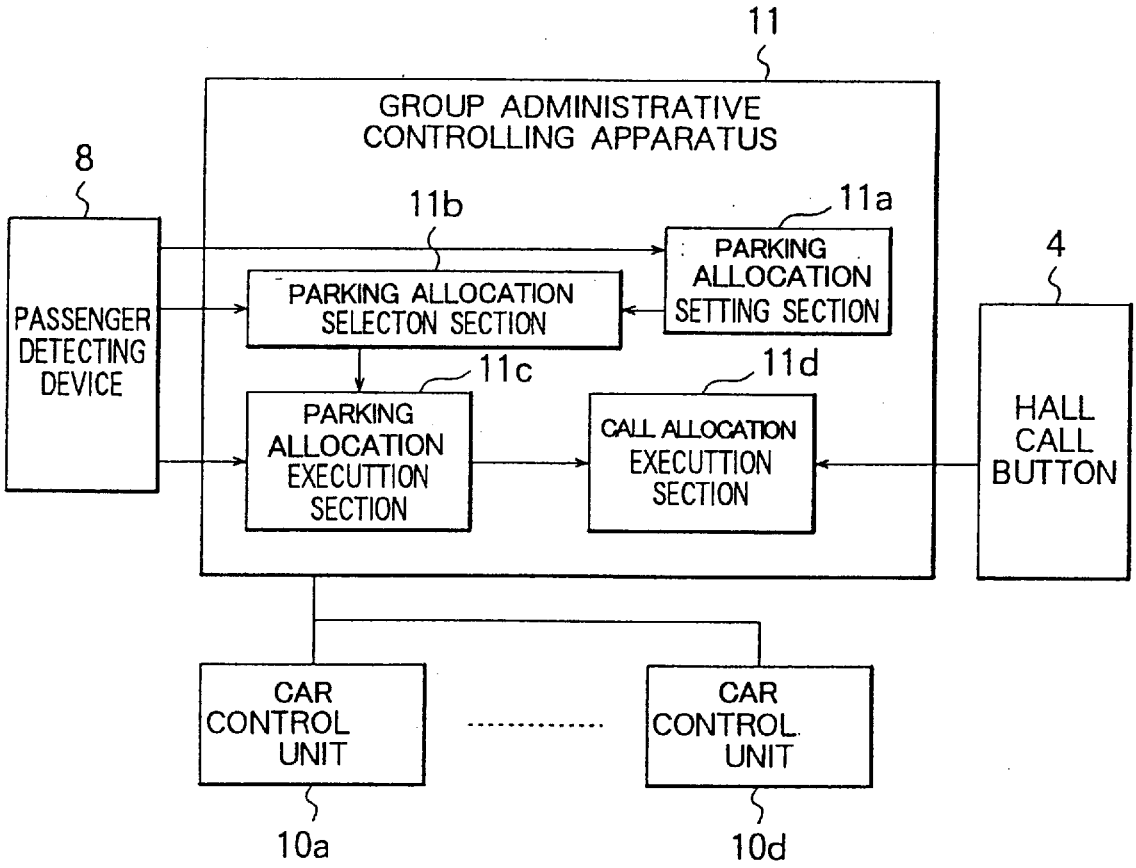
FIG. 5 is a block diagram showing a structure in accordance with embodiment 2 of the invention.
Figure 6:
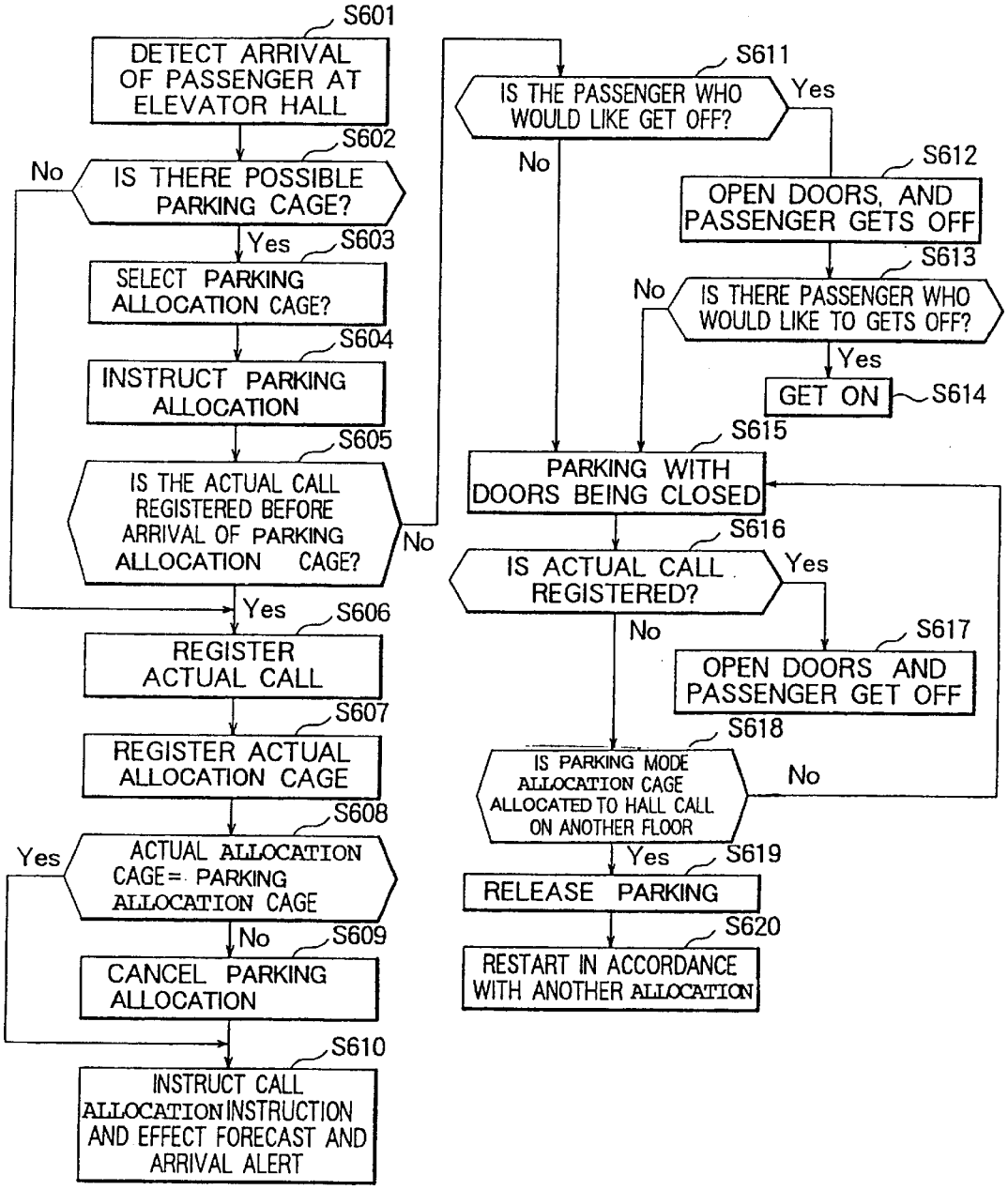
FIG. 6 is a flowchart illustrative of the operation of embodiment 2 of the invention.

FIG. 5 is a block diagram showing a structure in accordance with embodiment 2 of the invention, and FIG. 6 is a flowchart illustrative of the operation of embodiment 2 of the invention.

In FIG. 5, the same reference numerals are used to designate the same portions as those of embodiment 1 shown in FIG. 3 and the explanation therefor will be omitted. Numeral 11 that is additional one denotes the group administrative controlling apparatus of the elevators in accordance with embodiment 2, which is composed of a parking allocation setting section 11*a* for judging whether or not there exist cages that are not allocated to any hall call or cage call or cages that are not allocated to the hall call and stand-by a cage call of the floor to stand-by, that is, whether or not the parking allocation is to be performed, a parking allocation selection section 11*b* for selecting the cage as the parking allocation cage by the detection of the arrival of the passenger at the elevator hall with passenger detecting devices 8, a parking allocation execution section 11*c* for instructing the selected cage to travel to stand by the floor to stand-by, and a call allocation execution section 11*d* for registering the hall call to the elevator to which the parking is allocated when the passenger actually manipulates the hall call button 4 and for disabling the parking allocation to the subject floor. Incidentally, in some cases, the call allocation execution section 11*d* may have a function to notice the cage, allocated there, to the passenger as a forecast.

Here, in the case where the parking allocation setting section 11*a* has judged that there exist the subject cages for the parking allocation, the parking allocation selection section 11*b* selects the cage that may arrive at the subject floor earliest out of the subject cages when the parking allocation is performed.

Also, in the case where a hall call other than that on the floor to stand-by is generated and the call is allocated to the subject parking allocation cage before the cage arrives at the floor to stand-by after the parking allocation, the call allocation execution section 11*d* disables the parking allocation on the floor to stand-by.

Furthermore, in the case where the passenger on the floor to stand-by has not manipulate the hall call button 4 after the parking allocation by the time when the cage arrives at the floor to stand-by, and also a new allocation is not applied to the subject parking allocation cage even if another hall call is made, the cage is put on standby with the doors being closed after the arrival at the floor to stand-by without performing the arrival forecast or arrival alert.

The operation of the group administrative controlling apparatus of the elevators in accordance with embodiment 2 described above will now be described with reference to the flowchart shown in FIG. 6.

First of all, if the arrival of the passenger at the elevator hall is detected by the passenger detecting devices 8 in step S601, then the parking allocation judgement section 11*a* judges whether or not there exists a cage that may be one for the parking allocation in step S602. The possible cages for the parking allocation are selected in step S603 from cages that are stopping on the floor for the parking allocation, that are empty without any passengers, are not subjected to the hall call allocation and are not subjected to the destination floor call within the cages, or that are not subjected to the hall call allocation and are subjected to the destination floor call within the cages only for the floor for which the parking allocation is to be performed. With respect to the latter cages, it is predicted that the cages might move to the stand-by operation after the arrival at the floor for which the parking allocation is performed.

Namely, if it is judged in step S602 that the possible cages for the parking allocation do not exist, the process moves to step S606, to be described later, without operation of parking allocation. Inversely, if it is judged in step S602 that the possible cages for the parking allocation exist, the process moves to step S603. The cage that might earliest reach the floor, for which the stand-by operation is to be performed, is selected as a parking allocation cage out of the possible cages in the parking allocation selection section 11*b*. Subsequently, the parking allocation is instructed to the selected cage in the next step S604 so that the instructed cage travels toward the floor to stand-by in accordance with the allocation.

Subsequently, in the case where the passenger on the subject floor does not manipulate the hall call button 4 by the time when the parking allocation cage that has received a parking instruction in this step S604 arrives at the floor to stand-by, that is, the actual call is not actually registered (in the case where the judgement in step S605 is "NO"), the process moves to step S611. When there is no intention for the passengers to get on or off the cage after the arrival at the subject floor in step S611, i.e., in the case where the cage call is not registered for the subject floor (in the case where the judgement in step S611 is "NO"), the process moves to step S615, and the cage waits for the next instruction with doors 3 of the cage being closed under the door closing stand-by condition that the cage stands by with the door being closed. Also, for example, in the case where the cage call is registered for the subject floor and the passenger has an intention to get off the cage (in the case where the judgement in step S611 is "YES"), the doors 3 are once opened for the passenger to get off the cage. Thereafter, in step S613, the riding of the passenger into the cage is detected. If the passenger rides on (YES), the process moves to step S614, and it deemed that the passenger who comes to the elevator hall rides on the cage. The next travel is started in accordance with the operation by the passenger. In this case, if nobody rides on the cage (NO), the process moves to step S615 and the doors are closed. Thereafter, the cage is put on stand-by for the next instruction under the condition that the doors are closed. Namely, in this step S615, the doors that have been opened are closed and the doors that have been closed are continuously closed, without opening operation, and is put on stand-by for the next instruction.

Incidentally, when the passenger who comes to the elevator hall on the floor to stand-by manipulates the hall call button to thereby register the actual call in the stand-by condition with the doors being closed in step S615 (in the case where the judgement in S616 is "YES"), the doors of the stand-by cage with the doors being closed are opened for the passenger's use. Thereafter, the next travel is started in accordance with the operation by the passenger in the same way as instep S614. Also, if the hall call on the subject floor is not registered during the stand-by condition with the doors being closed (the judgement in step S616 is "NO"), and furthermore there is no call allocation like the call on another floor (the judgement in step S618 is "NO"), the stand-by condition with doors being closed (S615) is continued without any change. However, if there is a call allocation like a call on any other floor (the judgement in step S618 is "YES"), the process moves to step S619, and the stand-by condition with the doors being closed on the subject floor is released. Thereafter, the process moves to step S620 and restarts the operation in accordance with the allocation.

The operational steps of the above-described steps S604, S605, and S611 to S615 are executed in the parking allocation execution section 11*c*. The operational steps of steps S616 to S620 are executed in the call allocation execution section 11*d*.

Subsequently, before the parking allocation cage arrives at the subject floor in step S605 or in the case where it is judged that there is no cage on the parking allocation in step S602, if the hall call button 4 is manipulated by the passenger on the subject floor, the hall call that has been operated is registered as the actual call in step S606. In the next step S607, the selection is performed totally in consideration of the forecast waiting time for the passenger, the probability of the full occupation, the probability of failure of the forecast or the like in the same manner as in step S411 of FIG. 4 for the above-described embodiment 1. However, in the present embodiment 2, since the cage that is subjected to the parking allocation according to the invention and is moving toward the subject floor, i.e., the parking allocation cage is included in the cages to be selected, it is possible to realize the reduction of waiting time for the passenger on the subject floor.

Subsequently, in step S608, it is judged whether or not the cage selected as the parking allocation cage in step S603 is the same as the cage selected as the actual allocation cage in step S607. If they are the same, the process moves to step S610. Also, if they are not the same, the process moves to step S609 and the allocation for the cage that has been under the parking allocation condition is released. Accordingly, if the parking allocation is released during the travel, the continuation of the travel becomes wasteful. Unless the cage is subjected to the cage call or another allocation, the cage is stopped at the closest floor. Also, if there is neither cage call nor allocation and the cage is stopped, the cage is continuously served as the empty cage.

Subsequently, in step S610, the hall call allocation instruction is fed to the cage selected as the actual allocation cage in step S607, and furthermore, the forecast of the arrival of the cage or the alert of the arrival is performed for the passenger at the elevator hall.

The operations from the above-described steps S606 to S610 are also executed in the call allocation execution section 11*d*.

By realizing this embodiment 2, the parking allocation is performed when the arrival of the passenger at the elevator hall is detected so that the cage may travel earlier toward the subject floor. Therefore, it is possible to provide an elevator with a more quick response for the passenger. Also, even if the passenger once enters the elevator hall and returns back or the person simply passes through the elevator hall, the stand-by cage stays without opening the doors. Thus, it is possible to keep the elevator hall quiet without opening the doors for nobody therearound. Also, since the doors are closed, when the cage is subjected to the call allocation on another floor, the cage may immediately start traveling and respond thereto, thereby contributing to the improvement in overall building service.

Also, in the above-described embodiment 2, the case where a single group of a plurality of elevators is controlled has been described but the number of the elevators to be controlled may be one and the invention may be applied to the case of at least one elevator.

In the case where the administrative controlling apparatus is applied to control a single elevator, in the structure shown in FIG. 5, it is sufficient to provide at least the hall call button 4 provided at the elevator hall for registering the call of the elevator, the passenger detecting device 8 for detecting the person who has come to the elevator hall, the parking allocation execution section 11*c* for performing the parking allocation on the subject floor to the cage when the person is detected by the passenger detecting device 8, and for instructing the travel toward the subject floor, and the call allocation execution section 11*d* for registering the hall call when the passenger at the elevator hall on the subject floor manipulates the hall call button 4 and for disabling the parking allocation to the subject floor.

Then, the call allocation execution section 11*d* may be constructed so that, in the case where a hall call other than the floor to stand-by or a cage call while the cage is reaching the floor to stand-by after the parking allocation, the parking allocation on the subject floor is disabled, and also in the case where, after the parking allocation, the passenger has not manipulated the hall call button on the subject floor by the time when the cage arrives at the floor to stand-by, and also, there is no hall call on another elevator hall nor the cage call, the arrival forecast or arrival alert is not performed and is put on stand-by on the floor to stand-by with the doors being closed after the arrival.

Embodiment 3

Embodiment 3 for embodying the invention will now be described.

Figure 7:
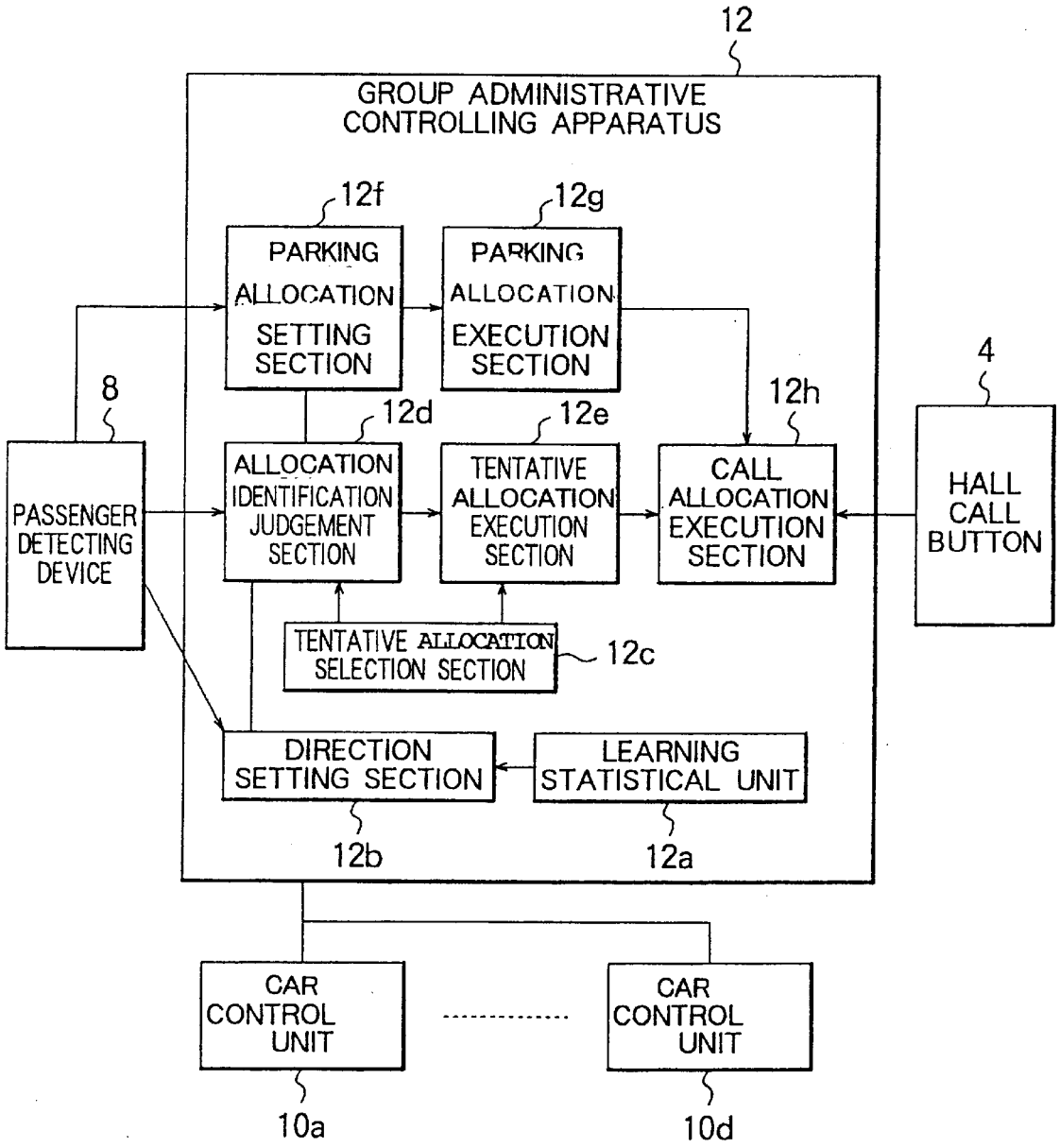
FIG. 7 is a block diagram showing a structure in accordance with embodiment 3 of the invention.
Figure 8:
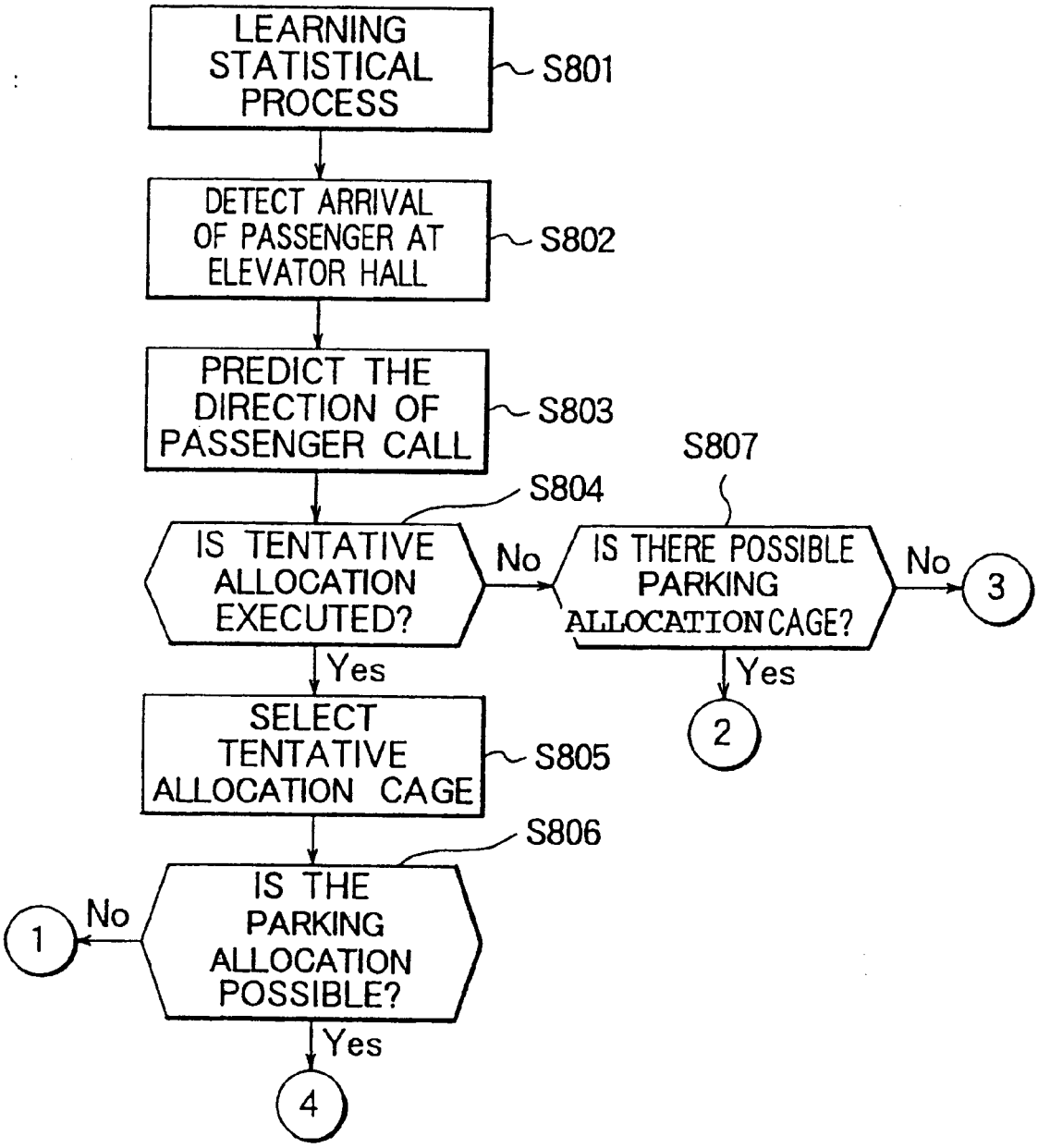
FIG. 8 is a flowchart illustrative of the operation of embodiment 3 of the invention.
Figure 9:
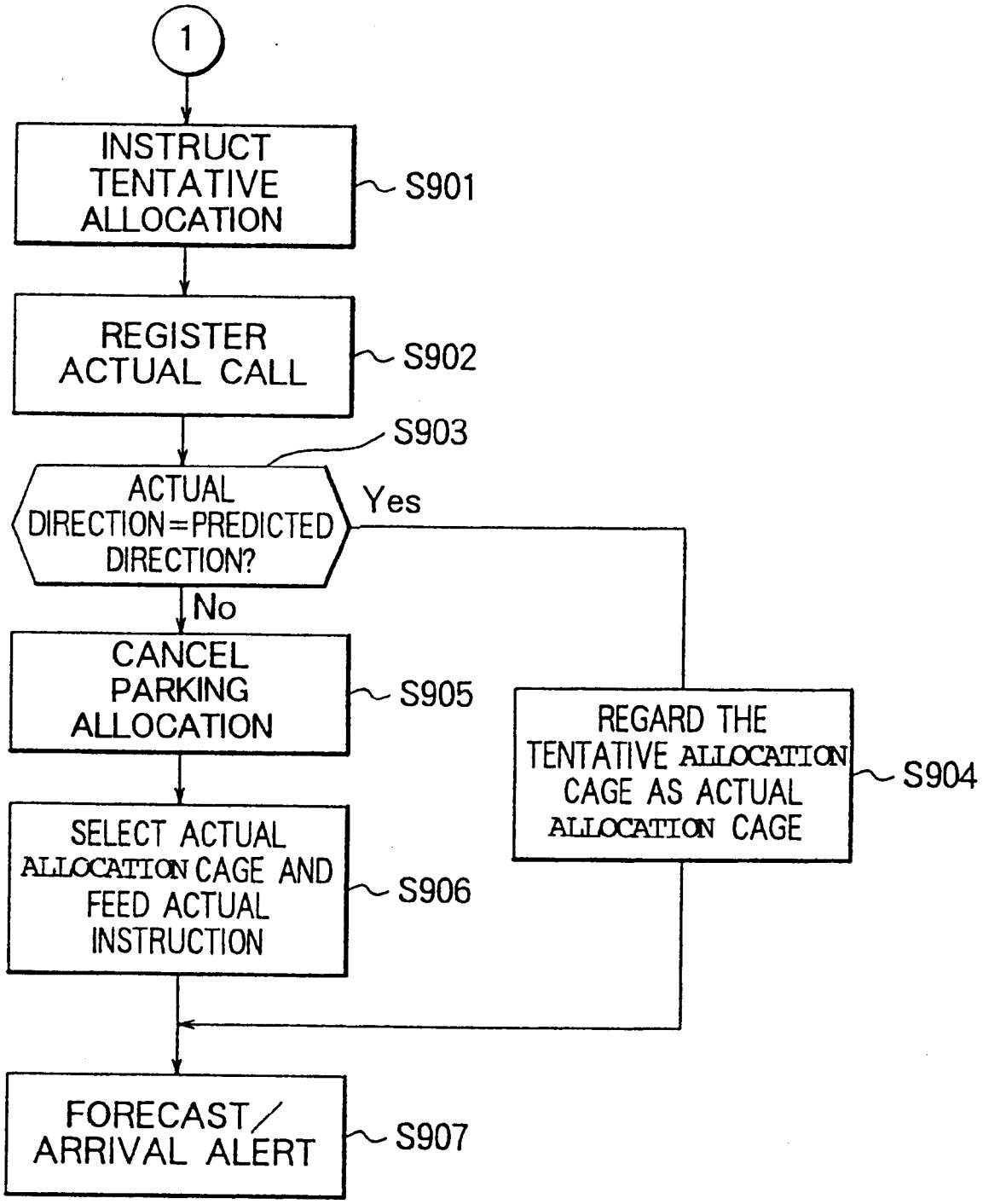
FIG. 9 is a flowchart continuous with FIG. 8.
Figure 10:
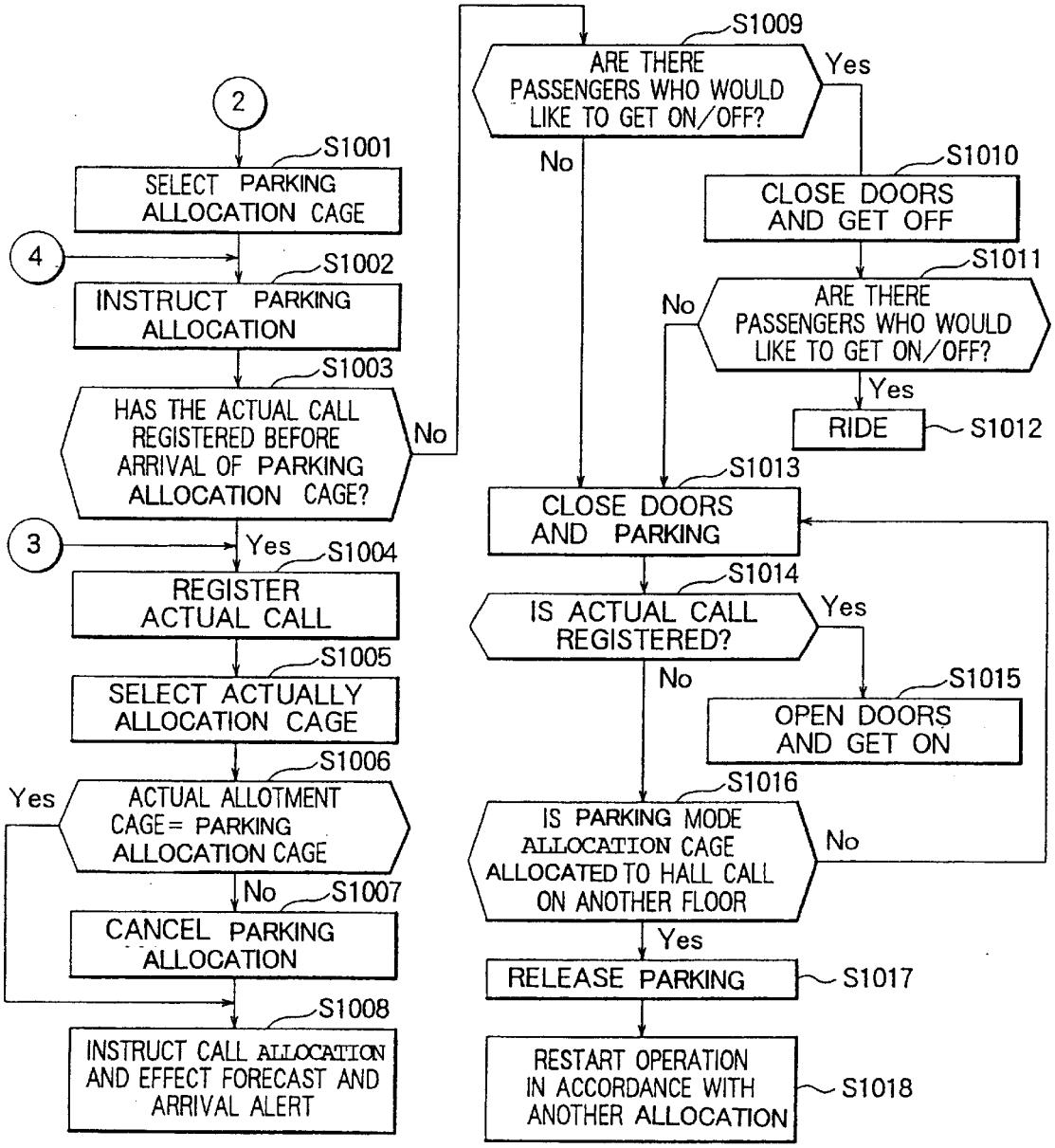
FIG. 10 is a flowchart continuous with FIG. 8.

FIG. 7 is a block diagram showing a structure in accordance with embodiment 3 of the invention, and FIGS. 8 to 10 are a flowchart illustrative of the operation of embodiment 3 of the invention.

In FIG. 7, the same reference numerals are used to designate the same portions as those of embodiments 1 and 2 shown in FIGS. 3 and 5 and the explanation therefor will be omitted. Numeral 12 that is an additional one denotes the group administrative controlling apparatus of the elevators in accordance with this embodiment 3, which is composed of a learning statistical section 12*a* for learning for every predetermined time period an operational history of the elevators including the number of registered travels of the hall call buttons 4 for every floors in different directions or the number of the passengers in different directions and for analyzing the features thereof in the same as in the learning statistical section 9*a*, a direction setting section 12*b* for predicting the directions of hall calls (UP/DOWN) which are predicted to be operated by the passengers, namely, the directions to be tentatively allocated in respond to the learning result of the above-described learned statistical section 12*a* in the same way as in the direction setting section 9*b*, a tentative allocation selection section 12*c* for selecting the cage to respond to the hall call in the predicted direction in the same way as in the tentative allocation selection section 9*c*, an allocation identification judgement section 12*d* for judging whether the tentative allocation is to be performed or the parking allocation is to be performed in accordance with the detection of the passenger, a tentative allocation execution section 12*e* for tentatively allotting the call to the cage selected by the tentative allocation selection section 12*c* in the case where the tentative allocation is to be performed in the same manner as in the tentative allocation execution section 9*d*, a parking allocation selection section 12*f* for selecting the cage as the parking allocation cage by the detection of the arrival of the passenger at the elevator hall with passenger detecting devices 8 in the case where the parking allocation is to be performed in the same way as in the parking allocation selection section 11*b*, a parking allocation execution section 12*g* for instructing the selected cage to travel to the floor to stand-by in the same way as in the parking allocation execution section 11*c*, and a call allocation execution section 12*h* for selecting the cage to respond to the call by the hall call button 4 actually operated by the passenger.

Here, on the basis of the past registered number in different directions of the hall call buttons for each floor and the numbers of the passengers in different directions, the direction setting section 12*b* regards, as the tentative allocation direction, the UP direction when the value obtained by dividing the registered number in the UP direction (or the number of the passengers) by the registered number in the DOWN direction (or the number of the passengers) is not smaller than a predetermined value and regards, as the tentative allocation direction, the DOWN direction when the value obtained by dividing the registered number in the DOWN direction (or the number of the passengers) by the registered number in the UP direction (or the number of the passengers) is not smaller than a predetermined value, and at the same time judges that the direction setting is impossible in the case where either value is less than the predetermined values. The tentative allocation selection section 12*c* selects the tentative allocation cage in accordance with the set tentative allocation direction in the case where the direction setting section 12*b* sets the tentative allocation direction. The allocation identification setting section 12*d* judges that the identification is the parking allocation in the case where the above-described direction setting section 12*b* judges that it is impossible to set the direction, and judges that it is the parking allocation in the case where the tentative allocation cage selected by the above-described tentative allocation selection section 12*c* may be subjected to the parking allocation, and judges to execute the tentative allocation in the case where it is impossible to be subjected to the parking allocation.

The operation of this embodiment 3 will now be described with reference to the flowchart shown in FIGS. 8 to 10. Incidentally, each step S8XX (step in 800th) is shown in FIG. 8, each step S9XX (step in 900th) is shown in FIG. 9 and each step S10XX (step in 1,000th) is shown in FIG. 10.

First of all, in step S801, the data concerning the getting-on/off of the elevator passenger every day is learned and statically processed in the learning statistical section 12*a* as the background process in the same manner as in the above-described step S401. The predicted value of the number of the passengers in different direction on each floor for every predetermined hour is obtained.

Subsequently, in step S802, if the passenger's arrival at the elevator hall is detected by the passenger detecting devices 8, then it is judged in step S803 onward whether the tentative allocation or the parking allocation is performed. An example of this judgement is shown.

Namely, in step S803, the direction which would be operated by the passenger is predicted in the direction setting section 12*b* in the same manner as in the above-described step S403. Then, in step S804, in the same manner as in the above-described step S404, it is judged whether or not the tentative allocation is possible, on the basis of the output of the direction setting section 12*b*, i.e., the predicted direction of the hall call. If the tentative allocation is possible (in the case where the judgement in step S804 is "YES"), the process moves to step S805, and the cage for the tentative allocation is selected. Then, in the next step S806, it is judged whether or not the parking allocation is possible for the cage selected in the foregoing step S805. Incidentally, it is possible to consider various methods for this judgement but any special one is not specified.

Here, in the case where it is judged that the subject cage may be subjected the parking allocation (in the case where the judgement in step S806 is "YES"), the process advances to step S1002 in FIG. 10. In order to perform the parking allocation rather than the tentative allocation, its parking allocation instruction is outputted to car control unit 10 of the subject cage. Thereafter, the process is executed in order of steps of step S1003 to be described later, onward. Also, in the case where the parking allocation is impossible for the subject cage (in the case where the judgement in step s806 is "NO"), the tentative allocation is performed. The process advances to step S901 in FIG. 9. Its tentative allocation instruction is outputted to car control unit 10 of the subject cage. Thereafter, the process is executed in order of the steps of step S902 to be described later, onward.

Incidentally, with respect to the steps after step S902 and after step S1003 to be described later, the step numbers are changed in conformity with the drawing number. However, the former steps are the same as those of the steps after step S407 shown in FIG. 4 and the latter steps are the same as those of the steps after step S605 shown in FIG. 6. The duplicated explanation will be omitted.

Subsequently, returning back to FIG. 8, in the case where it is judged in step S804 that it is impossible to be subjected to the tentative allocation (in the case where the judgement in step S804 is "NO"), in order to execute the parking allocation, in the next step S807, it is judged whether the parking allocation may be assigned. Here, if it is judged that the possible parking allocation cage exists (in the case where the judgement in step S807 is "YES"), after the execution of the selection of the parking allocation cage in step S1001 shown in FIG. 10, the parking allocation instruction is fed to that cage in the next step S1002. Incidentally, the steps after step S1002 are the same as those described above and hence the detailed explanation therefor will be omitted. Also, here, if it is judged that the possible parking allocation cage does not exist (in the case where the judgement in step S807 is "NO"), in the same manner, the process moves to step S1004 in FIG. 10, waiting for the registration of the actual call. If the actual call is registered, immediately, the optimum cage is selected. This step is the same as that described above.

The steps from step S802 to step S806 shown in FIG. 8 in this embodiment will be described by simulating the actual movement with reference to FIG. 11.

In the case where the arrival of the passenger is detected on, for example, a seventh floor, the explanation will be made on the basis of the case where the passenger who has come to the elevator hall on the seventh floor is to go in the DOWN direction in step S803 with reference to FIGS. 11(*a*) and 11(*b*).

Figure 11:
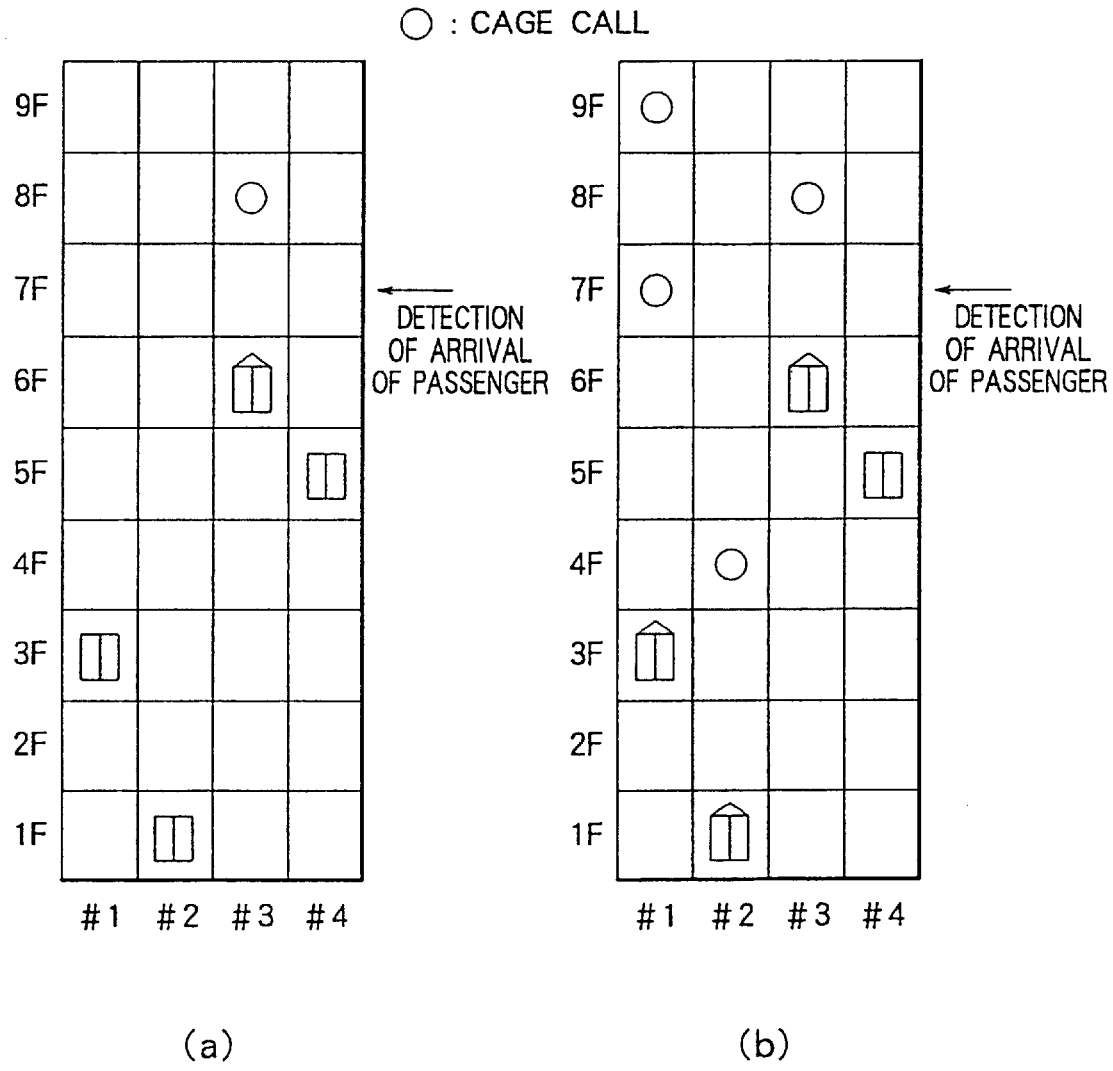
FIG. 11 is a view of auxiliary illustration of a relationship between a position and a call of the cage in accordance with the operation of embodiment 3 of the invention.

In FIG. 11(*a*), in a so-called non-directional door closing stand-by condition in which three cages having numbers #1, #2 and #4 are stopped without any designation in travel direction with the doors being closed, the cage #4 that is closest to the subject floor is usually selected as the cage to be tentatively allocated. Also, since this cage #4 is stopped without any call or allocation, it is judged that the cage may be subjected to the parking allocation. After all, the parking allocation instruction is fed to the cage #4. At this time, the call direction on the seventh floor is still the predicted one, and the parking allocation which may be the allocation without direction designation has the priority to the tentative allocation.

On the other hand, in FIG. 11(*b*), three cages other than the cage #4 are traveling in the UP direction with the UP direction. For example, at this time, in the case where it is predicted by the learning that the floor below these cages is crowded, it is considered that it is not preferable to travel the cage #4 in the UP direction toward the seventh floor. Accordingly, in such a case, it is preferable to feed the tentative allocation instruction to the cage #3.

Also, unlike the above-described situation, in the case where it is impossible to designate the passenger call direction in step S803 in FIG. 8, in FIG. 11(*a*), the parking allocation instruction is fed to the cage #4 in the same manner as described above. Furthermore, in FIG. 11(*b*) only the cage #4 is under the possible parking allocation, and hence the parking allocation instruction is fed to the cage #4.

In the embodiment 3 shown here, when the arrival of the passenger at the elevator hall is detected, it is judged whether the tentative allocation or the parking allocation is suitable. The allocation is effected on the basis of the above-described judgement before the passenger's operation of the hall call button to call the cage, whereby it is possible to respond more quickly to the passengers and to shorten the waiting time. Also, it is possible to effectively operate the group of the elevators and to reduce the waiting time for all the waiting passengers.

APPLICABILITY TO THE INDUSTRIAL USE

As described above, the administrative controlling apparatus of the elevators according to the invention may start calling the elevator to the floor having the elevator hall by detecting the arrival of the passenger at the elevator hall before the passenger manipulate the hall call button provided at the elevator hall. Accordingly, it is effective to shorten the waiting time for the passenger at the elevator hall, and furthermore, it leads to the enhancement in operation efficiency of the elevators.

What is claimed is:

1. An administrative controlling apparatus for elevators comprising:

a hall call button located at an elevator hall for registering a hall call for at least one elevator;

passenger detecting means for detecting a person who has come to the elevator hall;

a learning statistical section for learning for respective time intervals an operational history of the elevators, including numbers of travels in different directions for each floor and number of passengers traveling in different directions and for analyzing the number of travels and number of passengers;

a direction setting section for predicting, in response to learning of the learning statistical section, a predicted direction of travel for the hall call button operated for the floor when the passenger detecting means detects a person;

a tentative allocation selection section for selecting an elevator which becomes a tentative allocation in accordance with the predicted direction of travel; and a tentative allocation execution section for tentatively registering a hall call to the elevator selected by the tentative allocation selection section before operation of said hall call button.

2. An administrative controlling apparatus for elevators comprising:

a hall call button located at an elevator hall for registering a hall call for at least one elevator;

passenger detecting means for detecting a person who has come to the elevator hall;

a learning statistical section for learning for respective time intervals an operational history of the elevators, including numbers of travels in different directions for each floor and number of passengers traveling in different directions and for analyzing the number of travels and number of passengers;

a direction setting section for predicting, in response to learning of the learning statistical section, a predicted direction of travel for the hall call button operated for the floor when the passenger detecting means detects a person;

a tentative allocation selection section for selecting an elevator which becomes a tentative allocation in accordance with the predicted direction of travel; and a tentative allocation execution section for tentatively registering a hall call to the elevator selected by the tentative allocation selection section, wherein the tentative allocation execution section:

continues the tentative allocation when the hall call button is operated by a passenger on the floor after the tentative allocation, and the predicted direction of travel of the tentative allocation and the direction of travel indicated by operation of the hall call button are identical;

cancels the tentative allocation when the predicted direction of travel of the tentative allocation and the direction of travel indicated by the hall call button are not identical; and allots the direction of travel indicated by the hall call button.

3. An administrative controlling apparatus for elevators comprising:

a hall call button located at an elevator hall for registering a hall call for at least one elevator;

passenger detecting means for detecting a person who has come to the elevator hall;

a learning statistical section for learning for respective time intervals an operational history of the elevators, including numbers of travels in different directions for each floor and number of passengers traveling in different directions and for analyzing the number of travels and number of passengers;

a direction setting section for predicting, in response to learning of the learning statistical section, a predicted direction of travel for the hall call button operated for the floor when the passenger detecting means detects a person;

a tentative allocation selection section for selecting an elevator which becomes a tentative allocation in accordance with the predicted direction of travel; and a tentative allocation execution section for tentatively registering a hall call to the elevator selected by the tentative allocation selection section, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival at the floor of the tentative allocation.

4. The administrative controlling apparatus for elevators as recited in claim 1, wherein the direction setting section determines a direction of travel for the tentative allocation based on at least one of the number of travels, the number of passengers, and directions of travel for operations of the hall call button for a past identical time interval for the floor of the hall call button.

5. The administrative controlling apparatus for elevators as recited in claim 1, wherein the tentative allocation execution section:

continues the tentative allocation when the hall call button is operated by a passenger on the floor after the tentative allocation, and the predicted direction of travel of the tentative allocation and the direction of travel indicated by operation of the hall call button are identical;

cancels the tentative allocation when the predicted direction of travel of the tentative allocation and the direction of travel indicated by the hall call button are not identical; and allots the direction of travel indicated by the hall call button.

6. The administrative controlling apparatus for elevators as recited in claim 5, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival of the floor of the tentative allocation.

7. The administrative controlling apparatus for elevators as recited in claim 6, wherein the direction setting section determines a direction of travel for the tentative allocation based on at least one of the number of travels, the number of passengers, and directions of travel for operations of the hall call button for a past identical time interval for the floor of the hall call button.

8. The administrative controlling apparatus for elevators as recited in claim 5, wherein the direction setting section determines a direction of travel for the tentative allocation based on at least one of the number of travels, the number of passengers, and directions of travel for operations of the hall call button for a past identical time interval for the floor of the hall call button.

9. The administrative controlling apparatus for elevators as recited in claim 1, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival of the floor of the tentative allocation.

10. The administrative controlling apparatus for elevators as recited in claim 2, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival of the floor of the tentative allocation.

11. The administrative controlling apparatus for elevators as recited in claim 2, wherein the direction setting section determines a direction of travel for the tentative allocation based on at least one of the number of travels, the number of passengers, and directions of travel for operations of the hall call button for a past identical time interval for the floor of the hall call button.

12. The administrative controlling apparatus for elevators as recited in claim 11, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival of the floor of the tentative allocation.

13. The administrative controlling apparatus for elevators as recited in claim 3, wherein the direction setting section determines a direction of travel for the tentative allocation based on at least one of the number of travels, the number of passengers, and directions of travel for operations of the hall call button for a past identical time interval for the floor of the hall call button.

14. The administrative controlling apparatus for elevators as recited in claim 4, wherein the tentative allocation execution section does not effect an arrival forecast or an arrival alert when a passenger does not operate the hall call button between the tentative allocation and arrival of an elevator at the floor of the tentative allocation and, in the absence of another hall call, puts the elevator on standby with doors closed after arrival of the floor of the tentative allocation.

* * * * *

UNITED STATES PATENT AND TRADEMARK OFFICE

CERTIFICATE OF CORRECTION

PATENT NO. : 6,257,373 B1
DATED : July 10, 2001
INVENTOR(S) : Hikita et al.

It is certified that error appears in the above-identified patent and that said Letters Patent is hereby corrected as shown below:

Title page,
Items [22], [86] and [87], should read as follows:

| | | |
|---|---|---|
| -- [22] | PCT Filed: | **Jan. 19, 1998** |
| [86] | PCT No.: | **PCT/JP98/00180** |
| | § 371 Date: | **March 22, 1999** |
| | § 102(e) Date: | **March 22, 1999** |
| [87] | PCT No.: | **WO99/36340** |
| | PCT Pub. Date: | **July 22, 1999** --. |

Signed and Sealed this

Twentieth Day of January, 2004

JON W. DUDAS
*Acting Director of the United States Patent and Trademark Office*